United States Patent [19]

Van Derworp et al.

[11] Patent Number: 4,743,016

[45] Date of Patent: May 10, 1988

[54] VARIABLE THERAPEUTIC AND EXERCISE WEIGHTS

[76] Inventors: Mary K. Van Derworp, 17840 W. Black Canyon Hwy., #225; Candida E. Quist, 2121 W. Union Hills Dr., #110, both of Phoenix, Ariz. 85023

[21] Appl. No.: 784,767

[22] Filed: Oct. 7, 1985

[51] Int. Cl.[4] ..... A63B 21/06

[52] U.S. Cl. ..... 272/117; 272/122

[58] Field of Search ..... 272/67–68, 272/116–117, 119, 93, 122–124; 403/296–297; 273/68

[56] References Cited

U.S. PATENT DOCUMENTS

| | | | |
|---|---|---|---|
| 1,552,073 | 9/1925 | Mansfeldt | 272/117 |
| 1,714,391 | 5/1929 | McWhirter | 272/93 |
| 3,436,079 | 4/1969 | Berry et al. | 403/297 X |
| 3,482,834 | 12/1969 | James, Jr. | 272/122 |
| 3,572,702 | 3/1971 | Dorn | 272/123 |
| 3,820,781 | 6/1974 | Kane | 272/117 X |
| 4,157,827 | 6/1979 | Winston et al. | 272/117 X |
| 4,218,057 | 8/1980 | Wilson | 272/117 |
| 4,303,239 | 12/1981 | Walsh, Jr. | 272/119 |
| 4,322,072 | 3/1982 | White | 272/119 |
| 4,440,391 | 4/1984 | Saenz, Jr. et al. | 272/93 |
| 4,518,162 | 5/1985 | Oates | 272/117 X |
| 4,664,373 | 5/1987 | Hait | 272/117 |

*Primary Examiner*—Richard J. Apley
*Assistant Examiner*—Robert W. Bahr
*Attorney, Agent, or Firm*—Harry M. Weiss & Associates

[57] ABSTRACT

According to the present invention there is provided variable therapeutic and exercise weights which may be used for physical activity, and which are especially useful when used with physical rehabilitation patients. The inventive weights are capable of providing a full range of physical activity necessary for the rehabilitation of the physical rehabilitation patient. These variable therapeutic weights may be used for active exercise, active-assistive exercise and resistive exercise. The variable therapeutic and exercise weights according to the present invention comprise a plurality of hollow members, each of which may be weighted by providing suitable weights in the interior of the hollow members. There is further provided male-type and female-type coupling members which removably couple each of the hollow members to another hollow member. At least one of the hollow members will, preferably, be unweighted and having female-type coupling members at each of the respective ends of the hollow member. The remainder of the hollow members may be weighted of unweighted and capable of removably coupling each hollow member to another.

15 Claims, 2 Drawing Sheets

VARIABLE THERAPEUTIC AND EXERCISE WEIGHTS

DESCRIPTION OF THE INVENTION

This invention relates generally to weights which may be used for physical rehabilitation and muscular exercise. More particularly, the present invention relates to variable weights sticks which provide the physical rehabilitation patient with a wide range of weight selections providing maximum muscular exercise. Moreover, the present invention is highly versatile and allows a physical rehabilitation patient to perform active exercise, active-assistive exercise or resistive exercise.

Active exercise is achieved through the selection of the light weight components of the inventive weight set. Active exercise is useful at the stages of physical rehabilitation where the patient has bilateral weakness, or weakness on both sides of the body. Thus active exercise is effective only where both sides of the body are subjected to exercise using relatively light weight. By providing a uniformly light weight across both sides of the body, the inventive weights according to the present invention provide maximum exercise achievable with the weak patient.

Where a patient has a unilateral weakness, or is relatively stronger on one side of the body that the other, the physical rehabilitation indicated is active-assistive exercise. The unilaterally weak patient requires a greater quantum of exercise on his weaker side than on his stronger side. It is generally desirable to exercise both sides of the body at the same time, while providing maximum exercise for each of the stronger and weaker sides of the body. With the unilaterally weak patient, the stronger side of the body must be exercised in proportion to the weaker side of the body. Therefore, it is desirable to provide a device which is capable of being very light on one side while being heavier on the other side. The inventive variable therapeutic weights may be used in a manner which provides greater weight on the stronger side of the body, while providing lighter weight on the weaker side of the body.

As the physical rehabilitation patient progresses he will need to exercise with heavier combinations of weights. It has been found advantageous to allow the patient the option of having the weight oriented with the centerline of his body or of having the weight oriented on both sides of the body. This even distribution of weight provides resistive exercise for the physical rehabilitation patient, and exercises both sides of the body equally at the same time.

Many variations of lifting exercises, bending exercises or twisting exercises may be performed using the inventive variable therapeutic weights. Each type of exercise may be accomplished in such a manner as to provide either active exercise, active-assistive exercise or resistive exercise. When used in the manner described, the variable therapeutic weights according to the present invention provide therapeutic exercise for the arms, legs and trunk of the body.

Furthermore, it is desirable to provide a set of variable therapeutic weights which are capable of being used not only for active, active-assistive or resistive exercise, but may also be used as individual hand weights. When used as individual hand weights, the inventive variable therapeutic weights are useful for wrist flexion and extension exercises or for forearm supination and pronation exercises.

There is, therefore, a great need for variable therapeutic weights which are capable of accommodating a wide range of physical exercises needed in the physical rehabilitation and rehabilitation of the physical rehabilitation patient.

SUMMARY OF THE INVENTION

Accordingly, it is an object of the present invention to provide variable therapeutic weights which may be used to accommodate a broad range of physical exercises necessary for physical rehabilitation.

It is another object of the present invention to provide a combination of weights which may be used for active exercise, active-assistive exercise or resistive exercises.

It is yet another object of the present invention to provide variable therapeutic weights which may be used as hand weights for providing wrist flexion and extension exercises and forearm supination and pronation exercises.

It is still another object of the present invention to provide variable therapeutic weights which permit bilateral wrist activity by twisting the weights.

It is a further object of the present invention to provide weights which are safe and easy to use.

It is a still further object of the present invention to provide a set of variable therapeutic weights comprising a plurality of members which screwably interlock with each other, thereby providing a wide variety of weights and weight distributions.

These and other objects, features and advantages of the present invention will be apparent from the following, more particular description of the preferred embodiments of the invention as illustrated in the accompanying drawings.

DESCRIPTION OF THE PREFERRED EMBODIMENTS

Figure 1:
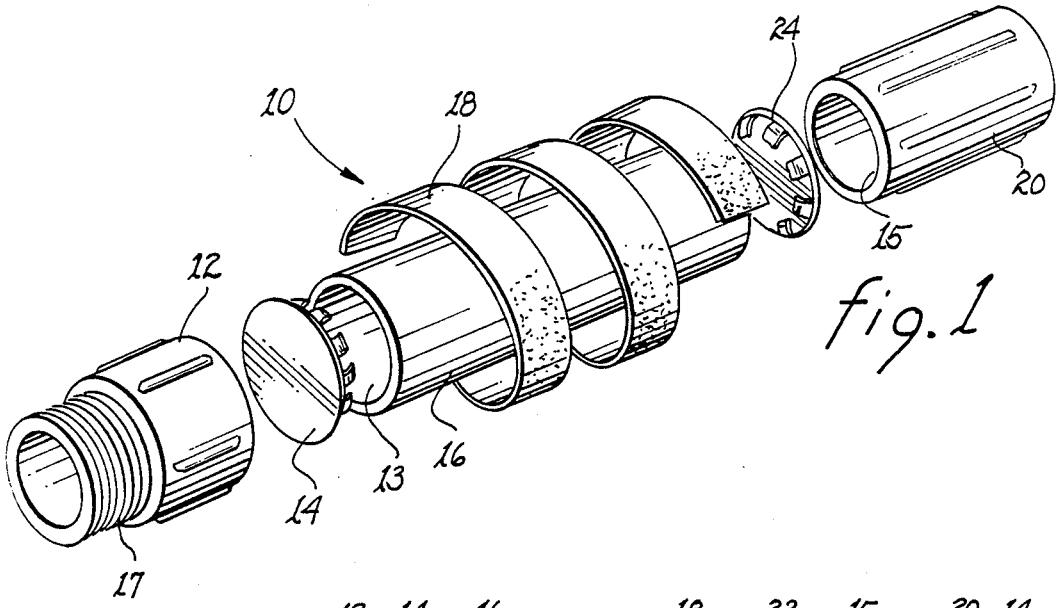
FIG. 1 is an exploded plan view of at least one of the members of the variable therapeutic weights according to the present invention showing the internal and external structures of the variable therapeutic weights.

In FIG. 1 there is shown at least one of the members 10 of a variable therapeutic weight set according to the present invention. Member 10 comprises a hollow member 16 which may be of any suitable length and of any suitable material, preferably a plastic material such as poly vinyl chloride or a light weight and high strength metal such as aluminum. Gripping means 18 is provided so as to provide a means for firmly grasping the variable therapeutic weights without having the weights slip. Hollow member 16 has openings 13 at each of two ends of hollow member 16. Sealing caps 14 removably engage the openings 13 of hollow member 16 thereby sealing shut openings 13 and creating chamber 23 in FIG. 2. End caps 14 have any suitable means for removably engaging openings 13 such that end members 12 and 20 are capable of operably coupling hollow member 16. In the preferred embodiment, end caps 14 have metal spring flanges 24 which operably couple to opening 13 by tension against the inside circumference of hollow member 16. Sealing caps 14 are of a sufficient diameter so as to permit connecting members 12 and 20 to operably couple member 16. Metal spring flanges 24 are arrayed in any manner sufficient to operably couple, by tension, the inside circumference of hollow member 16.

Figure 2:
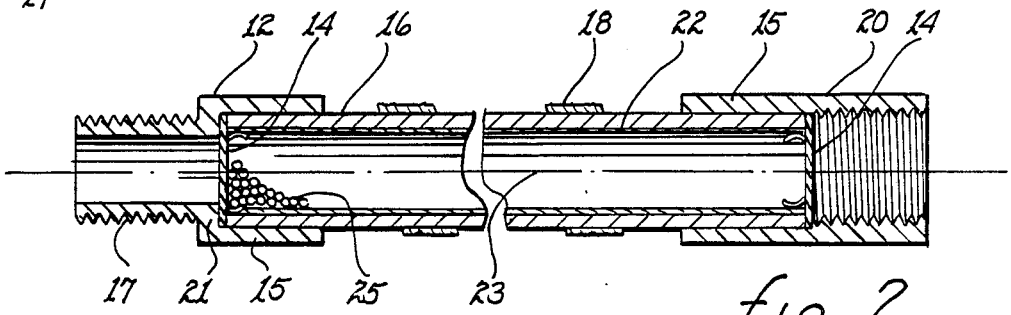
FIG. 2 is a cross-sectional side elevational view of at least one of the members of the variable therapeutic weights according to the present invention showing the inter-relationship of the internal and external structures of the variable therapeutic weights.

As best illustrated by reference to FIG. 2, coupling members 12 and 20 consist of male-type joining means and female-type joining means respectively. Coupling members 12 and 20 further consist of a body portion 15 which operably couples hollow member 16. Coupling member 12 further has a retaining seat 21 for tightly securing coupling member 12, sealing cap 14 and hollow member 16. The internal threads of coupling member 20 also serve to tightly secure coupling member 20, sealing cap 14 and hollow member 16. Coupling members 12 and 20 may be made of any suitable plastic or metal, preferably poly vinyl chloride. Any suitable means of securing coupling members 12 and 20 to hollow member 16 may be used. In the preferred embodiment of the inventive variable therapeutic weights, coupling members 12 and 20 are firmly secured to hollow member 16 by using any suitable adhesive for firmly securing poly vinyl chloride plastics, and applying said adhesive to the inner surface of body portion 15 and receivably coupling coupling members 12 and 20 with hollow member 16.

Coupling member 12 further has external threaded portion 17 and coupling member 20 further has internal threaded portion 19. External threaded portion 17 of one therapeutic weight 10 screwably engages the internal threaded portion 19 of another therapeutic weight member 10 thereby providing variable weights for various physical rehabilitation exercises.

Variable therapeutic weight member 10 may have additional weight added. If additional weight is desired weight member 10 may be weighted by adding a weight means 25 within chamber 23. In the preferred embodiment, inner liner 22 is provided for lining chamber 23 and weight means 25, consisting of any suitable material having weight, preferably lead shot, sand, concrete or rock, is added within inner liner 22. Inner liner 22 serves to prevent weight means 25 from spilling out in the unlikely event weight member 10 is dropped and breaks. Inner liner 22 may be made of any suitable material which will retain its integrity should hollow member 16 break, inner liner 22 consists, preferably, of a heavy paper, light cardboard, a thin and ductile plastic such as nylon or vinyl or rubber.

Figure 3:
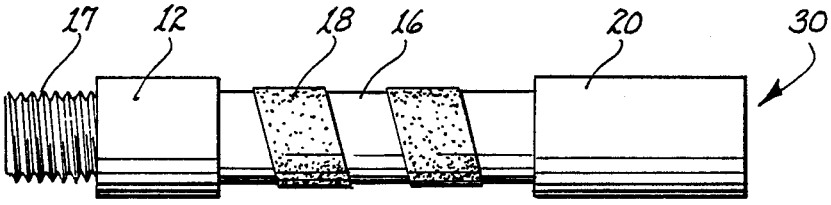
FIG. 3 is a side elevational view of at least one of the members of the variable therapeutic weights according to the present invention showing an externally threaded male-type end member and an internally threaded female-type end member.
Figure 4:
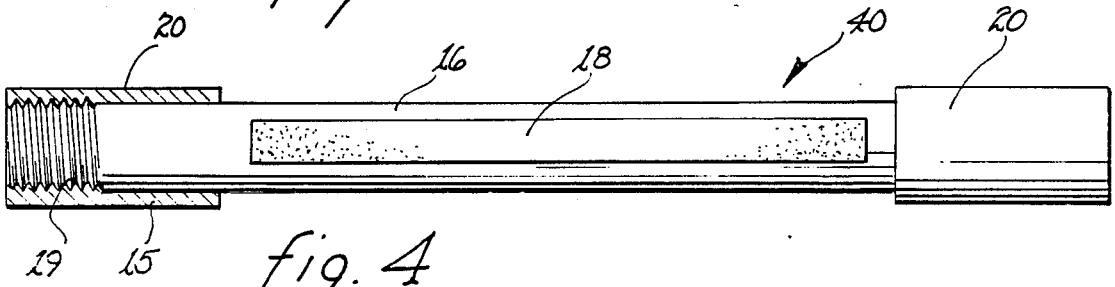
FIG. 4 is a side elevational view of at least one of the members of the variable therapeutic weights according to the present invention showing internally threaded female-type end members.
Figure 5:
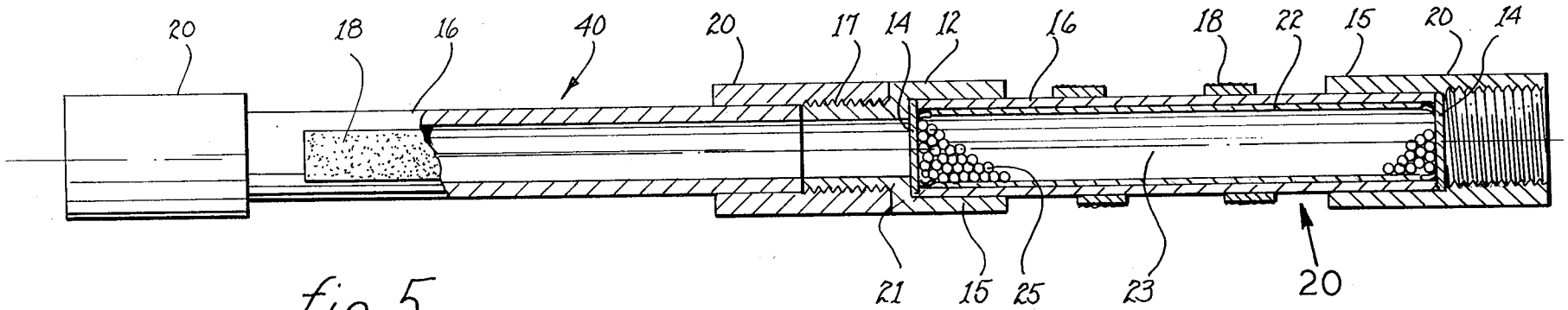

Any combination of variable therapeutic weight members 10 may be used. In the preferred embodiment, as illustrated by FIGS. 3 and 4, it has been found particularly advantageous to provide four weighted members 30 each having coupling members 12 and 20, two weighted members 30 being of a relatively greater length, and thereby of a relatively greater weight that the other two weighted members 30. Additionally, according to the preferred embodiment, is is advantageous to provide two unweighted members 10 and 40 of relatively greater length than the longer two members 30. Unweighted member 10 has a male-type coupling member 12 and a female-type coupling member 20, whereas unweighted member 40 has two female-type coupling members 20. Unweighted member 40 serves as a base member, onto which other therapeutic weight members 30 and 40 may be added in varying combinations according to the physical rehabilitation needs of the patient.

By screwably joining unweighted member 40 to one weighted member 30 active-assistive exercise may be performed whereby unilateral weighting provides proportionately equal exercise for both the relatively weaker side and relatively stronger side of the body. Screwably joining two weighted members 30 to both of coupling members 20 of unweighted member 40 permits resistive exercise utilizing bilateral weighting. Screwably joining unweighted members 10 and 40 permits active exercise utilizing very light weight.

While the invention has been particularly shown and described in reference to the preferred embodiments thereof, it will be understood by those skilled in the art that changes in form and details may be made therein without departing from the spirit and scope of the invention.

We claim:

1. A weight system for use in physical activity, comprising:

a plurality of weighted and unweighted members;

each of said plurality of weighted members further comprising a hollow member having apertures at the ends thereof, a resilient liner disposed within and lining the entire interior surface area of said hollow member and weight means disposed within said resilient liner disposed within said hollow member, for providing weight to said hollow member;

each of said plurality of unweighted members further comprising a hollow member having apertures at ends thereof;

wherein each of said plurality of weighted and unweighted members further comprises a metal cap having a plurality of spring flanges extending therefrom, integrally coupled to an interior surface of said apertures of said at least one hollow member having said weight means disposed therein; and a plurality of coupling members, each of said plurality of coupling members integrally coupled to an end of each of said plurality of weighted and unweighted members, wherein each of said plurality of coupling members removably joins with a corresponding one of said plurality of coupling members.

2. The weights for use in physical activity according to claim 1, wherein said plurality of coupling members further comprises at least one male-type coupling member and at least one female-type coupling member.

3. The weights for use in physical activity according to claim 2, wherein said male-type coupling member comprises:

a non-threaded female-type coupling end integrally coupled to said hollow member; and an externally threaded male-type coupling end integrally coupled to another hollow member.

4. The weights for use in physical activity according to claim 2, wherein said female-type coupling member comprises:

a non-threaded female-type coupling end integrally coupled to said hollow member; and an internally threaded female-type coupling end removably coupled to another hollow member.

5. The weights for use in physical activity according to claim 1, wherein each of said plurality of hollow members comprises any suitable plastic.

6. The weights for use in physical activity according to claim 1, wherein each of said plurality of hollow members comprises poly vinyl chloride.

7. The weights for use in physical activity according to claim 1, wherein each of said plurality of hollow members comprises any suitable lightweight rigid metal.

8. The weights for use in physical activity according to claim 1, wherein each of said plurality of hollow members comprises aluminum.

9. The weights for use in physical activity according to claim 1, wherein said weight means comprises lead shot.

10. The weights for use in physical activity according to claim 1, wherein said liner means comprises a cardboard material.

11. A variable therapeutic and exercise weight system for use in physical activity, comprising:

a plurality of unweighted tubular hollow plastic members, each hollow member further having an internal bore extending longitudinaliy therein and having an opening at each end of each of said plurality of tubular hollow plastic members; and a plurality of weighted members, each of said weighted members further comprising a tubular hollow plastic member having an internal bore extending longitudinally therein and having an opening at each end of said tubular hollow plastic member, a liner disposed within said internal bore covering the entire surface area thereof, and weights disposed within said internal bore of at least one of said plurality of tubular hollow plastic members;

a plurality of metal caps integrally coupled to each of said openings of said internal bores of each of said plurality of weighted and unweighted members, thereby sealing each of said tubular hollow members of said plurality of weighted and unweighted members, said metal caps further having spring flanges extending therefrom engaging an interior surface of said openings of said internal bores of each of said hollow members of said plurality of weighted and unweighted members;

a plurality of male-type coupling members integrally connected to ends of said plurality of tubular hollow members, each male-type coupling member further comprising:

a non-threaded female-type coupling end integrally coupled to said hollow member; and an externally threaded male-type coupling end removably coupled to another of said plurality of hollow members; and a plurality of female-type coupling members integrally connected to ends of said plurality of tubular hollow members, each female-type coupling member further comprising:

a non-threaded female-type coupling end integrally coupled to said hollow member; and an internally threaded female-type coupling end removably coupled to a corresponding one of said plurality of male-type coupling members of said hollow members.

12. The variable therapeutic and exercise weights for use in physical activity according to claim 11 wherein said plurality of hollow members, said male-type coupling members and said female-type coupling members comprise a poly vinyl chloride plastic material.

13. The variable therapeutic and exercise weights for use in physical activity according to claim 12, wherein any suitable adhesive is used to couple said said poly vinyl chloride plastic material coupling members to said poly vinyl chloride plastic material plurality of hollow members.

14. The variable therapeutic and exercise weights for use in physical activity according to claim 11 wherein each of said plurality of tubular hollow members further comprises at least one female-type coupling member integrally coupled thereto at a respective end of each of said tubular hollow member.

15. The variable therapeutic and exercise weights for use in physical activity according to claim 14, wherein at least one of said plurality of tubular hollow members comprises female-type coupling members integrally coupled thereto at each of the respective ends of said tubular hollow member, the remainder of said plurality of tubular hollow members further comprising male-type coupling members integrally coupled thereto at another respective end of each of said tubular hollow members.

* * * * *